US007053038B2

(12) United States Patent
Groot et al.

(10) Patent No.: US 7,053,038 B2
(45) Date of Patent: May 30, 2006

(54) PROCESS FOR THE PRODUCTION OF DETERGENT GRANULES

(75) Inventors: Andreas Theodorus Groot, Vlaardingen (NL); Cornelis Paulus Montanus, Vlaardingen (NL)

(73) Assignee: Unilever Home & Personal Care USA Division of Conopco, Inc., Greenwich, CT (US)

( * ) Notice: Subject to any disclaimer, the term of this patent is extended or adjusted under 35 U.S.C. 154(b) by 198 days.

(21) Appl. No.: 10/214,695

(22) Filed: Aug. 8, 2002

(65) Prior Publication Data

US 2003/0087792 A1 May 8, 2003

(30) Foreign Application Priority Data

Aug. 13, 2001 (GB) ..... 0119708.6

(51) Int. Cl.
*C11D 11/00* (2006.01)

(52) U.S. Cl. ..... 510/444; 510/495; 510/509; 23/313 FB; 264/117; 562/115

(58) Field of Classification Search ..... 510/444, 510/495, 509; 23/313 FB; 264/117; 562/115
See application file for complete search history.

(56) References Cited

U.S. PATENT DOCUMENTS

| | | | | |
|---|---|---|---|---|
| 3,425,948 | A * | 2/1969 | Otrhalek et al. | 510/455 |
| 4,734,224 | A * | 3/1988 | Barrett et al. | 510/357 |
| 4,919,847 | A * | 4/1990 | Barletta et al. | 510/442 |
| 5,486,317 | A | 1/1996 | Dorset et al. | 252/549 |
| 5,527,489 | A * | 6/1996 | Tadsen et al. | 510/294 |
| 5,633,224 | A | 5/1997 | Porter | 510/444 |
| 5,929,021 | A | 7/1999 | Dhanuka et al. | 510/444 |
| 6,133,223 | A * | 10/2000 | Sampaio et al. | 510/444 |
| 6,432,905 | B1 * | 8/2002 | Gowrishankaran et al. | 510/441 |
| RE37,949 | E * | 12/2002 | Emery et al. | 510/446 |
| 6,514,930 | B1 * | 2/2003 | Emery et al. | 510/444 |
| 6,518,233 | B1 * | 2/2003 | Emery et al. | 510/444 |
| 6,518,234 | B1 * | 2/2003 | Emery et al. | 510/445 |

FOREIGN PATENT DOCUMENTS

| | | |
|---|---|---|
| EP | 345 090 | 12/1989 |
| EP | 555 622 | 8/1993 |
| EP | 936 269 | 8/1999 |
| WO | 99/04359 | 2/1996 |
| WO | 96/06917 | 3/1996 |
| WO | 99/00475 | 1/1999 |
| WO | 00/37605 | 6/2000 |
| WO | 01/14511 | 3/2001 |

OTHER PUBLICATIONS

Co-pending U.S. Appl. No. 10/214,669, filed Aug. 8, 2002, Akkermans et al.
Co-pending U.S. Appl. No. 10/197,106, filed Jul. 17, 2002, Lopez.
Co-pending U.S. Appl. No. 10/198,681, filed Jul. 17, 2002, Lopez.

* cited by examiner

*Primary Examiner*—Lorna M. Douyon
(74) *Attorney, Agent, or Firm*—Rimma Mitelman

(57) ABSTRACT

A low shear mechanical granulation process for the production of detergent granules, the process comprising contacting an acid precursor of an anionic surfactant, a non-surfactant acid and a solid carbonated neutralising agent wherein the solid carbonated neutralizing agent has a $d_{3,2}$ average particle size no more than 90 μm, preferably no more than 80 μm, more preferably no more than 70 μm, still more preferably no more than 60 μm, yet more preferably no more than 50 μm and especially no more than 40 μm.

23 Claims, No Drawings

PROCESS FOR THE PRODUCTION OF DETERGENT GRANULES

TECHNICAL FIELD

The present invention relates to a process for the production of detergent compositions by a non-spray drying process.

BACKGROUND OF THE INVENTION

Traditionally, detergent powders were produced by spray drying However, the spray drying process is both capital and energy intensive and the products were quite bulky, having a relatively low bulk density.

The desire for powders with higher bulk densities led to the development of processes which employ mainly mixing, without the use of spray drying. These mixing techniques offer great flexibility in producing powders of various different compositions from a single plant, by post-dosing various components after an initial granulation stage. The resultant powders have fairly high bulk densities, which is desirable for some product forms. However, many of these non-spray drying techniques are unsuitable for production of powders over a wide bulk density range and in particular, for the production of lower bulk density powders.

One kind of process, which does not involve spray-drying, and which is capable of producing medium bulk densities between those of spray dried and other non-spray dried powders, involves use of a low shear granulator, usually a fluidised bed apparatus. Although fluidised bed granulation processes per se can give good control of bulk density, there was still a need for greater flexibility and in particular, for producing lower BD powders.

A common fluidised bed process involves contacting a neutralising agent such as an alkaline detergency builder with a liquid acid precursor of an anionic surfactant in the fluidised bed or other low shear apparatus. Such a process is described in WO-A-96/04359. The acid precursor is thereby neutralised to the salt form of the surfactant and the surfactant and other components inside the apparatus form granules.

In order to adapt the low shear granulation process of WO-A-96/04359 to produce lower bulk densities, it was proposed in WO-A-99/00475 to incorporate some inorganic acid together with the liquid acid precursor of the anionic surfactant. A subsidiary advantage of this process is that the powders produced show improved dissolution rates in the wash liquor. However, there is no mention of any effect of the particle size of the neutralizing agent used to neutralise the anionic acid precursor and the inorganic acid.

WO-A-00/37605 discloses a process in which an organic (non-surfactant) acid is used in combination with a carbonated neutralising agent to provide products with bulk densities below about 600 g/l. In the examples, the neutralizing agent, sodium bicarbonate, is of 5–40μm size. However, the total disclosure only mentions high shear mixer/granulators and there is no link made between the particle size of the neutralising agent and the bulk density of the product.

It is an object of the present invention to use a non-surfactant salt formed in situ to yield lower bulk densities and optionally also, improved powder properties, in lower shear mechanical granulation processes.

This object is achieved by forming the salt from a neutralising agent having a smaller particle size.

DEFINITION OF THE INVENTION

The present invention provides a low shear mechanical granulation process for the production of detergent granules, the process comprising contacting an acid precursor of an anionic surfactant, a non-surfactant acid and a solid carbonated neutralising agent wherein the solid carbonated neutralising agent has a $d_{3,2}$ average particle size no more than 90 μm, preferably no more than 80 μm, more preferably no more than 70 μm, still more preferably no more than 60 μm, yet more preferably no more than 50 μm and especially no more than 40 μm.

Relative to equivalent granules produced by equivalent low shear processes whereby the average particle size of the neutralising agent is larger, granules produced by the present invention have lower bulk densities and optionally one or more of the following benefits, namely better flow, less stickiness, smaller particle size, narrower particle size distribution and better dissolution in water. In some embodiments, the process of the present invention may enable a higher surfactant loading of the granules whilst maintaining acceptable powder properties.

DETAILED DESCRIPTION OF THE INVENTION

The process of the present invention may be carried out in either batch or continuous mode of operation as desired.

The Solid Carbonated Neutralising Agent

As used herein, the term "solid carbonated neutralising agent" means any material introduced to the process as a solid and which is able to release carbon dioxide upon reaction with the non-surfactant acid.

The solid carbonated neutralising agent preferably comprises one or more materials selected from alkali metal carbonates, sesqicarbonates and bicarbonates, preferably sodium salts thereof, as well as burkeite.

The neutralising agent is most preferably present at a level sufficient to neutralize fully the anionic acid precursor and (in the first aspect of the present invention) the non-surfactant acid. If desired, a stoichiometric excess of neutralising agent may be employed to ensure complete neutralisation and/or to perform an alternative function. For example, if the neutralizing agent comprises sodium carbonate, it can act as a alkaline buffering agent or detergency builder, the latter especially when also accompanied by a seed crystal material such as calcite.

The maximum $d_{3,2}$ average particle size of the solid carbonated neutralising agent is expressed above and in claim 1. Preferably the minimum $d_{3,2}$ particle size of the solid carbonated neutralising agent is 1 μm, more preferably 4 μm, most preferably 10 μm.

By "average $d_{3,2}$ size" is meant the surface weighted mean diameter given by the equation:

$$d_{3,2} = \left[ \sum_{i}^{m} \frac{n_i D_i^3}{\sum_{i}^{m} n_i D_i^2} \right]$$

wherein $n_i$ is the number of particles in size class i $D_i$ is the median diameter value in size class i m is the number of size classes It evaluation is performed by sieve analysis, preferably at least 8 sieves are used. However, preferably laser diffraction is used, e.g. using a Sympatec or Malvern instrument In that case, preferably analysis is carried out on the basis of at least 31 size classes.

Of course, a given $d_{3,2}$ average particle size may be inherent in a commercially available raw material, or may be achieved by milling a commercial sample. It may also be achieved by mixing two or more raw materials of different morphologies.

The solid carbonated neutralizing agent may be provided as a raw material already having the required particle size or it may be sourced as more coarse material and reduced by an appropriate technique such as milling.

The Acid Precursor of an Anionic Surfactant

The acid precursor of the anionic surfactant may actually comprise one or more acid precursors of different anionic surfactants. The most preferred of these is alkyl benzene sulphonic acid, for example having from 10 to 14 carbon atoms on average, in the alkyl chain thereof. Other suitable acid precursors of anionic surfactants comprise the acid precursors of primary alkyl sulphates and alkyl olefin sulphonates, as well as the acid precursors of alkyl ether sulphates. In all cases, these materials preferably have on average in the aliphatic moiety thereof, from 10 to 18 carbon atoms.

Within the scope of the term "acid precursor of an anionic surfactant" are saturated and unsaturated fatty acids, the resultant "anionic surfactant" therefore being soap. Typical chain lengths of these fatty acids are from 10 to 18 carbon atoms.

The Non-Surfactant Acid

The non-surfactant acid is an essential feature of the first aspect of the invention and an optional feature of the second aspect of the invention. It may comprise one or more inorganic acids which are compatible with the anionic surfactant precursor and/or one or more organic acids which are not surfactants or acid precursors of anionic surfactants. Preferably, non-surfactant organic acids have less than 10, more preferably less than 8, in some cases, less than 6 carbon atoms, e.g. formic acid, acetic acid, propionic acid, citric acid, malic acid, maleic acid, fumaric acid, aspartic acid, glutaric acid, tartaric acid, malonic acid, succinic acid, adipic acid, 3-chetoglutaric acid and citramalic acid. Of the inorganic acids, sulphuric acid is preferred. However, other suitable inorganic acids include, for example, phosphoric acid, nitric acid and hydrochloric acid, and mixtures thereof.

As indicated in WO-A-99/00475, acid precursors of anionic surfactants commonly include inorganic acid, usually sulphuric acid, as an impurity or by-product of their process of manufacture. WO-A-99/00475 states that the inorganic acid should constitute at least 2.5% by weight of the acidic component (i.e. anionic acid precursor plus inorganic acid). The most preferred level is 20% by weight of that total. These levels of non-surfactant acid in the process of the present invention are also desirable. However, WO-A-99/00475 also sets a preferred upper limit of 50% by weight of the acidic component.

Nevertheless, in the context of the present invention, it is even more preferred that the non-surfactant acid is used at a level which is at least 50%, still more preferably at least 60%, especially at least 70% by weight of the total weight of the anionic acid precursor plus non-surfactant acid.

Notwithstanding the exact amount of non-surfactant acid used relative to the non-surfactant acid precursor, of more significance to the reduction bulk density and other benefits is the total amount of salt formed in situ by reaction of the non-surfactant acid with the neutralising agent. It is preferred that this amount of in situ salt is at least 5% by weight, preferably at least 10% by weight, more preferably at least 25% by weight, most preferably at least 50% of those granules. The level of salt thus produced depends in self-evident fashion, upon the amounts of non-surfactant acid and neutralising agent used. This is in contrast to the teaching of WO-A-99/00475 which only mentions a maximum level of 4% by weight of in situ salt on the basis of the weight of the granules. The maximum total in situ salt level in the granules, is preferably 95%, more preferably 90%, still more preferably 80% and especially 60% by weight of the granules.

Where the non-surfactant acid is a solid, preferably it is introduced as a solution in an appropriate solvent such as water. Inorganic acids and some organic non-surfactant acids are supplied in various concentrations. As well as salt impurities, the remainder of the product is mainly water. The non-surfactant acid will often be a source of water introduced to the process. Preferably, this is kept to a minimum. However, towards the end of the process, optionally a little water or preferably, an aqueous solution of an inorganic alkali such as sodium hydroxide or sodium silicate, may be sprayed on separately, to reduce stickiness.

The total water in all components applied at or around the time of contacting the neutralising agent with the non-surfactant acid and anionic acid precursor does not exceed 25 wt % of the total of acid precursor plus non-surfactant acid, but preferably no more than 10 wt %. If the water level is above 10%, preferably drying is carried out in the granulator or in a subsequent stage, e.g. using heated air. However, if desired, a controlled amount of water may be added to facilitate neutralisation. The water may be added in amounts of 0.5 to 10 wt % by weight of the final detergent composition. Any such water is suitably added prior to or together or alternating with the addition of the acidic components.

The in situ Formed Salt

The first aspect of the invention requires the in situ formation of the salt.

The precise nature of the salt formed will depend on the amounts and nature of the reactants and the reaction conditions. For example, in the case of sulphuric acid and any of the neutralising agents recited in the previous section, the resultant salt may be a sulphate, hydrogen sulphate, mixed carbonate/sulphate etc. or mixtures thereof.

Order of Addition of Components

The mechanical granulation apparatus may comprise a single such apparatus or two or more apparatuses connected in series, provided at least one is of low shear type. Where two or more such machines are connected in series, individual starting materials may be added in different machines. Whether there is one or more machines, individual components may be dosed into different positions in those machines.

However, the most preferred way of carrying out the first aspect of the present invention is to pre-mix at least part of the anionic acid precursor and the non-surfactant acid and dose that mixture into the apparatus to contact the carbonated solid neutralising agent.

Another variant is for the non-surfactant acid and the anionic acid precursor to be dosed separately into the apparatus simultaneously to contact the neutralising agent.

Another variant comprises separate dosing of the anionic acid precursor and the non-surfactant acid sequentially into the apparatus to contact the neutralising agent, such that at least some of the acid precursor contacts the neutralising agent before start of dosing of the non-surfactant acid, or vice versa, with at least some overlap time in dosing. The non-surfactant acid may even be dosed starting from the time at, or after, cessation of the dosing of the anionic acid precursor.

The least preferred embodiment is with sequential dosing, i.e. with overlap, or immediately sequentially, or with a time interval therebetween, of the non-surfactant acid and the acid precursor, such that dosing of the non-surfactant acid starts before dosing of the anionic acid precursor.

Variants of the above methods will readily be appreciated by those skilled in the art, for example with "pulsed" dosing of anionic acid precursor and non-surfactant acid, either with time overlap or with time intervals therebetween. However, the aforementioned general principles still generally apply.

The Mechanical Granulation Apparatus

The present invention requires use of a low shear granulator. As used herein, the term "low shear mechanical granulation process" means a process whereby the only or the final stage of granulation is effected by a low shear non-spray-drying method, i.e. using a low shear mechanical granulator. Thus, as well as processes which do not involve spray drying at any stage, it also includes, for example, a process whereby a feed of solids produced by spray-drying is passed to a subsequent process stage wherein the spray-dried particles are involved in further granulation by a process which includes a low shear non-spray drying granulation technique. The term would not encompass a technique whereby spray-dried powders are further dried in a low shear apparatus unless they are also at that stage, granulated with some further component. The term does include processes where pre-granulation occurs in a non-low shear mixing apparatus and further granulation occurs in a low shear machine, but preferably, at least some neutralisation of non-surfactant acid then occurs in that low shear apparatus.

A preferred kind of low shear granulator is of the gas fluidisation type, which comprises a fluidisation zone in which the liquid binder is sprayed into or onto the solid neutralising agent. However, a rotating drum matching, or V-blender can also be used. When the low shear granulator is of the gas fluidisation kind it may sometimes be preferable to use equipment of the kind provided with a vibrating bed.

If the low-shear granulator is of the gas fluidization kind, then the anionic acid precursor and non-surfactant acid can be sprayed from above and/or below and/or within the midst of the fluidised material comprising the solid neutralising agent.

If a gas fluidisation granulator is used as the low-shear granulator, then preferably it is operated at a superficial air velocity of about 0.1–2.0 $ms^{-1}$, either under positive or negative relative pressure and with an air inlet temperature ranging from −10° or 5° C. up to 80° C., or in some cases, up to 200° C. An operational temperature inside the bed of from ambient temperature to 60° C. is typical. Depending on the process, it may be advantageous to vary the temperature (upwardly and/or downwards, during at least part of the process).

A low-shear granulator used in the process of the present invention may be adapted to recycle "fines", i.e. powdered or part-granular material of vary small particle size, so that they are returned to the input of the low shear granulator and/or input of any pre-mixer/granulator. Preferably the fine particulates are elutriated material, e.g. they are present in the air leaving a gas fluidisation chamber.

It is preferred to operate the fluidised bed granulator such that solid material is contacted with a spray of the liquid components to meet the requirement that the excess velocity ($U_e$) of fluidisation gas relative to the mass or volume flux of the spray ($q_{mliq}$ or $q_{vliq}$) when determined at the normalised nozzle-to-bed distance ($D_0$) is set so that the flux number ($FN_m$ or $FN_v$) as determined by $$FN_m = \log_{10}\left[\frac{\rho_p U_e}{q_{mliq}}\right] \text{ OR } FN_v = \log_{10}\left[\frac{U_e}{q_{vliq}}\right]$$

(where $\rho_p$ is the particle density) is at a critical value of at least 2 for at least 30% of the process.

It is also preferred that $d_{3,2}$ average droplet diameter of the liquid components is not greater than ten times the $d_{3,2}$ average particle diameter of that traction of the solids which has a $d_{3,2}$ particle diameter of from 20 μm to 200 μm, provided that if more than 90% by weight of the solid starting material has a $d_{3,2}$ average particle diameter less than 20 μm then the $d_{3,2}$ average particle diameter of the total solid starting materials shall be taken to be 20 μm. If more than 90% by weight of the solid starting material has a $d_{3,2}$ average particle diameter greater than 200 μm than the $d_{3,2}$ average particle diameter of the total starting solid material shall be taken to be 200 μm.

In a refinement of processes of the invention which use a low shear granulator, the neutralising agent may be contacted and mixed with a first portion of the acid components in a first mixer, which may be for example a low, moderate or high shear mixer to form a partially granulated material. Suitable granulators for carrying out this first stage are described in more detail hereinbelow. This can then be admixed with a second portion of the acid components in a low shear granulator, to form the granulated detergent product. If the acidic components are dosed separately in this way, they do not necessarily need to comprise the same ratio of anionic acid precursor to non-surfactant acid.

In such a two-stage granulation process, it is preferred, but not absolutely necessary, for the total of liquid binder to be dosed only in the partial granulation (first) and second steps. Conceivably, some could be dosed before partial granulation and/or other fluidisation. Also, the content of the liquid binder (e.g. the non-surfactant acid content) could be varied between the partial granulation and second stages.

Whether or not an initial pre-granulation step is used, particulate material comprising the solid neutralizing agent and optionally, other components, may be introduced into the fluidised bed and the required amounts of anionic acid precursor and non-surfactant acid then introduced, preferably by spraying, onto the said material, preferably from above. Optionally, a flow aid may be introduced with the starting materials. However, it is preferred that the flow aid be added after introduction of part of the anionic acid precursor and/or non-surfactant acid, in order to improved powder properties.

However, the invention requires use of a low shear mechanical granulator. Other suitable granulators for an optional pre-granulation step include a high speed mixer/granulator such as a Lodige® CB machine or a moderate-speed mixer such as a Lodige® KM machine. Other suitable equipment includes Drais® T160 series manufactured by Drais Werke GmbH, Germany; the Littleford mixer with internal chopping blades and turbine-type miller mixer having several blades on an axis of rotation. A low- or high-shear mixer granulator has a stirring action and/or a cutting action which are operated independently of one another. Preferred types of low- or high-shear mixer granulators are mixers of the Fukae® FS-G series; Diozna® V series ex Dierks & Sohne, Germany; Pharma Matrix® ex. T. K. Fielder Ltd, England. Other mixers believed to be suitable for Use in the process of the invention are Fuji® VG-C series ex Fuji Sangyo Co., Japan; the Roto® ex Zanchetta & Co. srl, Italy and Schugi® Flexomix granulator.

Yet another suitable mixer is the Lodige (Trade Mark) FM series (ploughshare mixers) batch mixer ex Morton Machine Co. Ltd., Scotland.

Compositional Features

The invention also encompasses both granules and detergent compositions obtainable by a process according to the present invention.

Granules made by a process according to the present invention optionally contain one or more additional components in addition to those arising from processing of the anionic acid precursor, the non-surfactant acid and the neutralising agent.

In addition, granules made by a process according to the present invention may be incorporated in a detergent composition comprising one or more post dosed materials. Solid post-dosed materials comprise powders, other granules (whether or not made by a process other than the invention) and mixtures thereof. Granules made by the process of the invention and post-dosed solids can simply be admixed or subject to further granulation by any suitable process. Post-dosed liquids are conveniently sprayed onto the granules themselves and/or onto (if present) any post-dosed solids.

As well as the non-surfactant acid (where applicable) and anionic acid precursors (which are usually pourable or viscous liquids, or pastes), one or more other liquid materials such as liquid nonionic surfactants and/or organic solvents may be applied to any suitable stage. The total amount of anionic acid precursor and non-surfactant acid will normally be as high as possible, subject to the presence of any other components and subject to other considerations referred to below. Some of the anionic acid precursor and any non-surfactant acid optionally may be pre-neutralised. Other optional components applied at or around the time of contacting the neutralising agent with the anionic acid precursor and any non-surfactant acid, preferably constitute less than 5 wt %, more preferably less than 2 wt %, of the total of non-surfactant acid plus anionic acid precursor but may constitute up to 25 wt %, 50 wt % or even 75 wt % of the liquid binder.

The weight ratio of all acid precursor(s) of anionic surfactant(s) to any optional nonionic surfactants, will normally be from 20:1 to 1:20. However, this ratio may be, for example, 15:1 or less, 10:1 or less, or 5:1 or less of acid precursors of anionic surfactant(s) to nonionic surfactants(s). On the other hand, the nonionic may be the major component so that the ratio is 1:5 or more, 1:10 or more, or 1:15 or more of acid precursors of anionic surfactant(s) to nonionic surfactants(s). Ratios in the range from 5:1 to 1:5 a of acid precursors of anionic surfactant(s) to nonionic surfactants(s) are also possible.

Optionally, a "layering agent" or "flow aid" may be introduced at any appropriate stage. This is used to improve the granularity of the product, e.g. by preventing aggregation and/or caking of the granules. It has already been described above, how such a material may be introduced. Any layering agent/flow aid is suitably present in an amount of 0.1 to 15 wt % of the detergent composition and more preferably in an amount of 0.5 to 5 wt %.

Suitable flow aids include crystalline or amorphous alkali metal silicates, aluminosilicates including zeolites, Dicamol, calcite, diatomaceous earth, silica, for example precipitated silica, chlorides such as sodium chloride, sulphates such as magnesium and sodium sulphate, carbonates such as calcium carbonate and phosphates such as sodium tripolyphosphate. Mixtures of these materials may be employed as desired.

In addition to the anionic surfactant obtained by the neutralisation step, further anionic surfactants or nonionic surfactants as mentioned above, also cationic, zwitterionic, amphoteric or semipolar surfactants and mixtures thereof may be added at a suitable time. In general, suitable surfactants include those generally described in "Surface active agents and detergents" Vol. I by Schwartz and Perry. If desired, soap derived from saturated or unsaturated fatty acids having, for example, $C_{10}$ to $C_{18}$ carbon atoms may also be present.

The total detergent active is suitably present at a level of 5 to 40 wt %, preferably 10 to 30 wt % of the final granulated detergent product.

A complete detergent composition often contains a detergency builder. Such a builder may be introduced with the neutralising agent and/or added subsequently as desired. Preferably, the builder is introduced with the neutralising agent. However, as already explained, some carbonated solid neutralising agents by themselves, or in the presence of a co-agent, can act as builders. Sodium carbonate is a typical example. Therefore, such materials may be incorporated in excess of the amounts necessary to neutralise the anionic acid precursor and non-surfactant acid.

Generally speaking, the total amount of detergency builder in the granular detergent product is suitably from 10 to 80 wt %, preferably 15 to 65 wt % and more preferably 15 to 50 wt %.

Other suitable builders include crystalline and amorphous aluminosilicates, for example, zeolites as disclosed in GB 1 473 201, amorphous aluminosilicates as disclosed in GB 1 473 202 and mixed crystalline/amorphous aluminosilicates as disclosed in GB 1 470 250; and layered silicates as disclosed in EP 164 514B. Inorganic phosphate builders, for example, sodium orthophosphate, pyrophosphate and tripolyphosphate, may also be present.

Aluminocilicates, whether used as layering agents and/or incorporated in the bulk of the particles may suitably be present in a total amount from 10 to 60 wt % and preferably an amount of from 15 to 50 wt % of the granulated detergent product. The zeolite used in most commercial particulate detergent compositions is zeolite A. Advantageously, however, maximum aluminium zeolite P (zeolite MAP) described and claimed in EP 384 070 may be used. Zeolite MAP is an alkali metal aluminosilicate of the P type having a silicon to aluminium ratio not exceeding 1.33, preferably not exceeding 1.5, and more preferably not exceeding 1.07.

Organic builders that may be present include polycarboxylate polymers such a polyacrylates, acrylic/maleic copolymers, and acrylic phosphinates; monomeric polycarboxylates such as citrates, gluconates, oxydisuccinates, glycerol mono-di- and trisuccinates, carboxymethyloxysuccinates carboxymethyloxymalonates, dipicolinates, hydroxyethyliminodiacetates, alkyl- and alkenylmalonates and succinates; and sulphonated fatty acid salts. A copolymer of maleic acid, acrylic acid and vinyl acetate is especially preferred as it is biodegradable and thus environmentally desirable. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %. Citrates can also be used at lower levels (e.g. 0.1 to 5 wt %) for other purposes. The builder is preferably present in alkali metal salt, especially sodium salt form.

Suitably, the builder system may comprise a crystalline layered silicate, for example, SKS-6 ex Hoechst, a zeolite, for example, zeolite A and optionally an alkali metal citrate.

Detergent compositions according to the invention may also suitably contain a bleach system. Fabric washing compositions may desirably contain peroxy bleach compounds, for example, inorganic persalts or organic peroxyacids, capable of yielding hydrogen peroxide in aqueous solution.

Granules obtained by the process of the present invention suitably have a low bulk density in the range 300 to 650 g/l, or 450 to 650 g/l, for example, in the proximity of 500 g/l and is thus comparable to a bulk density obtained by the method of spray-drying.

The composition may also comprise a particulate filler which suitably comprises an inorganic salt, for example sodium sulphate and sodium chloride. The filler may be present at a level of 5 to 60% by weight of the composition.

A fully formulated detergent composition produced according to the invention might for example comprise the detergent active and builder and optionally one of more of a flow aid, a filler and other minor ingredients such as colour, perfume, fluorescer, bleaches and enzymes.

The invention will now be illustrated by the following non-limiting examples.

EXAMPLES

This example illustrates the effect of using milled sodium carbonate an a neutralising agent for a LAS/sulphuric acid mixture, on the bulk density of a granular detergent product.

Liquid solutions comprising various ratios of linear alkyl benzene sulphonic acid (LAS) and sulphuric acid were prepared as indicated in Table 1. The liquid solutions were then sprayed onto particulate material in a fluidised bed apparatus at a temperature of 60° C.–70° C. The particulate material comprised sodium carbonate as neutralizing agent, added in excess to cope with the alternative function as a builder, and other materials such as sodium tripolyphosphate (STP), zeolite (as a flow aid), sodium sulphate (as a filler) and minors such as fluorescer and anti-redeposition agent (SCMC). Fluid bed granulation effected the formation of neutralised acids and the production of a free flowing granular detergent product.

In control A, the sodium carbonate was a commercial grade of having a $d_{3,2}$ average particle size of 106 μm, In Examples 1–5 of the invention, the same carbonate was milled to have a $d_{3,2}$ average particle size of 35 μm.

Table 1

| | Examples obtained with (milled) soda ash. | | | | | |
|---|---|---|---|---|---|---|
| | Control A | Ex. 1 | Ex. 2 | Ex. 3 | Ex. 4 | Ex. 5 |
| Liquid phase (%) | | | | | | |
| Las | 100 | 100 | 71.3 | 55.5 | 45.3 | 38.3 |
| Sulphuric acid | 0 | 0 | 28.7 | 44.5 | 54.1 | 61.7 |
| | Final composition (wt %) | | | | | |
| NaLAS | 19.1 | 19.1 | 18.9 | 18.6 | 18.3 | 18.1 |
| Sodium Carbonate | 29.4 | — | — | — | — | |

Table 1-continued

| | Examples obtained with (milled) soda ash. | | | | | |
|---|---|---|---|---|---|---|
| | Control A | Ex. 1 | Ex. 2 | Ex. 3 | Ex. 4 | Ex. 5 |
| Milled Sodium Carbonate | — | 29.4 | 29.0 | 28.5 | 28.1 | 27.7 |
| STP | 2.1 | 2.1 | 2.1 | 2.1 | 2.0 | 2.0 |
| In-situ sodium sulphate | 0 | 0 | 10.4 | 20.4 | 30.3 | 39.8 |
| Sodium sulphate | 42.2 | 42.2 | 31.1 | 20.5 | 10.1 | 0 |
| Water | 0.5 | 0.5 | 1.8 | 3.1 | 4.3 | 5.5 |
| Zeolite (80% ac.) | 6.2 | 6.2 | 6.1 | 6 | 5.9 | 5.8 |
| Minors, impurities | 0.6 | 0.6 | 0.7 | 0.8 | 1.0 | 1.1 |
| | Powder properties | | | | | |
| Bulk Density [g/l] | 686 | 614 | 498 | 462 | 454 | 432 |
| % Volume compression | 42 | 33 | 26 | 25 | 25 | 17 |
| Stickiness [kg] | 4.0 | 2.0 | 2.5 | 1.4 | 1.4 | 1.4 |
| $T_{90}$ 355–500 μm fraction | 52 | 44 | 38 | 28 | 22 | 13 |

The measurements of stickiness and $T_{90}$ dissolution were determined as follows:

Stickiness

This test is used to measure the cohesiveness of a detergent powder. The powder is compressed into a compact and the force required to break the unconfined compact is measured. The total weight required to break the compact (in kg) is stated in the table.

Dissolution Test

The detergent powder is added to water of 18 degrees French Hardness, at a temperature of 25° C. and which is stirred at a constant rate. As the powder dissolves, the ionic strength of the solution increases proportionately with time and is measured using a conductivity probe. By plotting conductivity versus time a profile of the dissolution rate of the powder can be generated. The time at which 90% of the maximum conductivity has been reached, is reported.

The invention claimed is:

1. A low shear mechanical granulation process for the production of detergent granules of a low bulk density in the range of 300 to 650 g/l, the process comprising contacting in a low shear granulation apparatus comprising a gas fluidization granulator an acid precursor of an anionic surfactant, a non-surfactant acid and a solid carbonated neutralizing agent wherein the solid carbonated neutralizing agent has a $d_{3,2}$ average particle size of at least 10 μm and no more than 90 μm, wherein the amount of the non-surfactant acid is at least 60% by weight of the total of the acid precursor of an anionic surfactant and the non-surfactant acid, and wherein a stoichiometric excess of solid carbonated neutralizing agent is used, relative to the amount of anionic acid precursor plus non-surfactant acid.

2. A process according to claim 1 wherein the solid carbonated neutralizing agent has a $d_{3,2}$ average particle size no more than 40 μm.

3. A process according to claim 1, wherein the non-surfactant acid is selected from one or more inorganic acids and non-surfactant organic acids.

4. A process according to claim 3, wherein the inorganic acid is selected from sulphuric acid, nitric acid, phosphoric acid, hydrochloric acid and mixtures thereof.

5. A process according to claim 1 wherein the amount of salt formed in situ in the resultant detergent granules by reaction between the non-surfactant acid and the neutralizing agent is at least 5% by weight.

6. A process according to claim 5 wherein the amount of salt formed in situ in the resultant detergent granules by reaction between the non-surfactant acid and the neutralizing agent is at least 50% by weight.

7. A process according to claim 1, wherein at least part of the anionic acid precursor and non-surfactant acid are pre-mixed prior to contacting the solid neutralizing agent.

8. A process according to claim 1, wherein the anionic acid precursor and non-surfactant acid are dosed sequentially.

9. A process according to claim 8, wherein at least part of the anionic acid precursor contacts the neutralizing agent before start of dosing of the non-surfactant acid, such that at least some non-surfactant acid is dosed at the same time that anionic acid precursor is being dosed.

10. A process according to claim 8, wherein at least part of the non-surfactant acid contacts the neutralizing agent before start of dosing of the anionic acid precursor, such that at least some anionic acid precursor is dosed at the same time that non-surfactant acid is being dosed.

11. A process according to claim 1, wherein the amount of the non-surfactant acid is at least 70% by weight of the total of the acid precursor of an anionic surfactant and the non-surfactant acid.

12. A process according to claim 1, wherein the process comprises use of a low shear mechanical granulation apparatus in the form of a fluid bed granulator.

13. A process according to claim 12 wherein at least some of the solid carbonated neutralizing agent dosed to the low shear granulator is pre-granulated in a mechanical granulator.

14. A process according to claim 1, wherein the anionic acid precursor is the acid precursor of an alkylbenzene sulphonate, primary alkyl sulphate, alkyl olefin sulphonate, alkyl ether sulphate or a mixture thereof.

15. A process according to claim 1 wherein the solid carbonated neutralizing agent is selected from alkali metal carbonates, bicarbonates, sesquicarbonates, burkeite and mixtures thereof.

16. A low shear mechanical granulation process for the production of detergent granules of a low bulk density in the range of 300 to 650 g/l, the process comprising contacting an acid precursor of an anionic surfactant, a non-surfactant acid and a solid carbonated neutralizing agent in a low shear granulation apparatus comprising a gas fluidization granulator wherein the solid carbonated neutralizing agent has a $d_{3,2}$ average particle size of at least 10 μm and no more than 90 μm wherein the amount of salt formed in situ in the resultant detergent granules by reaction between the non-surfactant acid and the neutralizing agent is at least 5% by weight, wherein the amount of the non-surfactant acid is at least 60% by weight of the total of the acid precursor of an anionic surfactant and the non-surfactant acid.

17. A process according to claim 16 wherein the solid carbonated neutralizing agent has a $d_{3,2}$ average particle size no more than 40 μm.

18. A process according to claim 16, wherein the non-surfactant acid is selected from one or more inorganic acids and non-surfactant organic acids.

19. A process according to claim 16, wherein the inorganic acid is selected from sulphuric acid, nitric acid, phosphoric acid, hydrochloric acid and mixtures thereof.

20. A process according to claim 16 wherein the amount of salt formed in situ in the resultant detergent granules by reaction between the non-surfactant acid and the neutralizing agent is at least 50% by weight.

21. A process according to claim 16, wherein at least part of the anionic acid precursor and non-surfactant acid are pre-mixed prior to contacting the solid neutralizing agent.

22. A process according to claim 16, wherein the anionic acid precursor and non-surfactant acid are dosed sequentially.

23. A process according to claim 16, wherein the amount of the non-surfactant acid is at least 70% by weight of the total of the acid precursor of an anionic surfactant and the non-surfactant acid.

* * * * *